US006911290B2

(12) United States Patent
Ogata et al.

(10) Patent No.: US 6,911,290 B2
(45) Date of Patent: Jun. 28, 2005

(54) ELECTROPHOTOGRAPHIC IMAGE RECEIVING SHEET AND PROCESS FOR IMAGE FORMATION USING THE SAME

(75) Inventors: Yasuhiro Ogata, Shizuoka (JP); Hiroshi Yamamoto, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 83 days.

(21) Appl. No.: 10/429,674

(22) Filed: May 6, 2003

(65) Prior Publication Data

US 2004/0013964 A1 Jan. 22, 2004

(30) Foreign Application Priority Data

May 8, 2002 (JP) ..... 2002-132575

(51) Int. Cl.[7] ..... G03G 13/20
(52) U.S. Cl. ..... 430/124; 428/688
(58) Field of Search ..... 430/124; 428/688

(56) References Cited

U.S. PATENT DOCUMENTS 3,876,463 A * 4/1975 Cree ..... 428/206
5,087,507 A * 2/1992 Heinzer ..... 428/195.1
5,258,277 A * 11/1993 Ogata et al. ..... 430/538

FOREIGN PATENT DOCUMENTS

| | | | |
|---|---|---|---|
| JP | 61-259246 | A | 11/1986 |
| JP | 06-286320 | A | 10/1994 |
| JP | 07-243193 | A | 9/1995 |
| JP | 07-301939 | A | 11/1995 |
| JP | 08-248667 | A | 9/1996 |
| JP | 2001-201822 | A | 7/2001 |
| JP | 2001-270234 | A | 10/2001 |

* cited by examiner

*Primary Examiner*—John L Goodrow
(74) *Attorney, Agent, or Firm*—Sughrue Mion, PLLC

(57) ABSTRACT

The present invention is directed to an electrophotographic image-receiving sheet capable of forming high quality images with brilliance, a sense of depth, good distinction, and high quality, and also to a process for image formation using this electrophotographic image-receiving sheet. The electrophotographic image-receiving sheet of the present invention is formed from a support, and a toner-image-receiving layer disposed on the support, in addition, regular reflectance of the surface of the toner image-receiving layer at 440 nm and at 560 nm is both 2% or more.

20 Claims, 1 Drawing Sheet

FIGURE
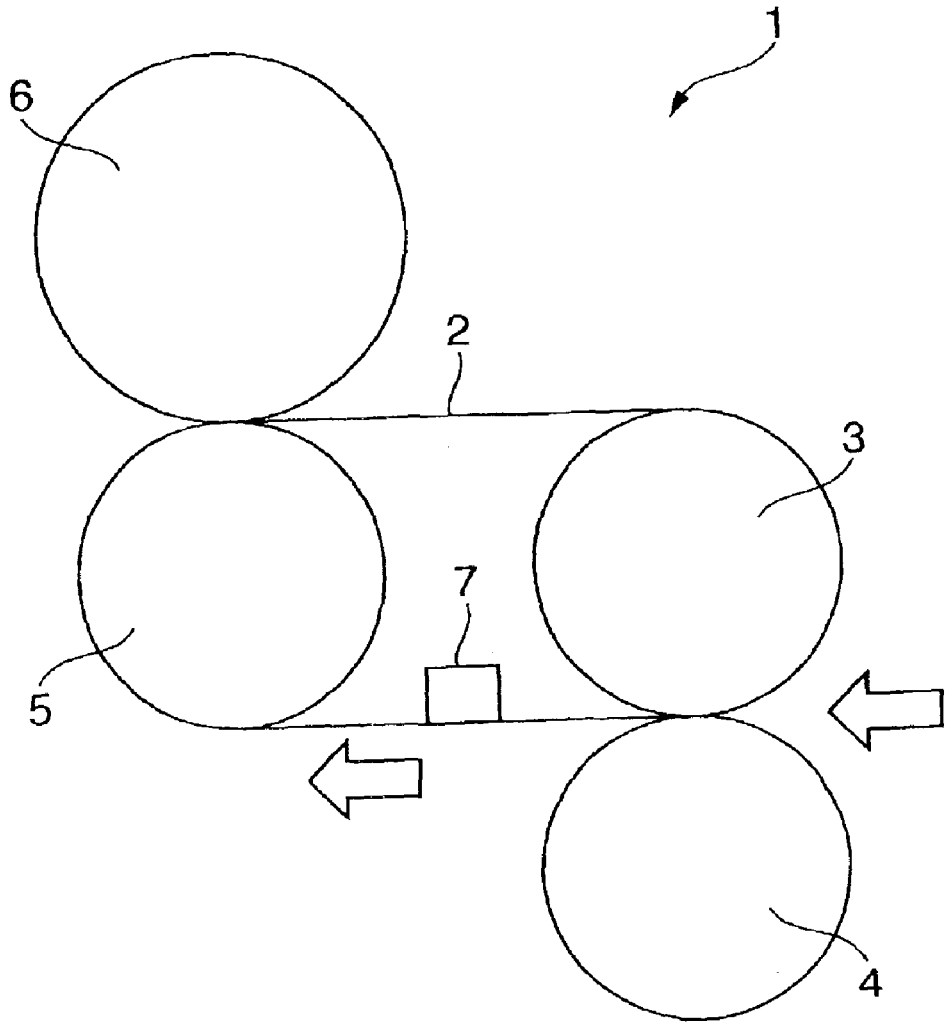

ELECTROPHOTOGRAPHIC IMAGE RECEIVING SHEET AND PROCESS FOR IMAGE FORMATION USING THE SAME

BACKGROUND OF THE INVENTION

1. Field of the Invention

The present invention relates to an electrophotographic image-receiving sheet which can form high quality images particularly with brilliance, a sense of depth, superior distinction and high clarity, and to a process for image formation using this electrophotographic image-receiving sheet.

2. Description of the Related Art

Electrophotography is an image-forming method using a photoconductive effect and a static electricity phenomenon, and is broadly used in various fields. The electrophotographic images may be formed on a semiconducting material such as zinc oxide paper, or by transferring a toner image from a semiconducting material to a recording material. The latter method is widely adopted in office copiers, and its imaging principle is as follows.

First, an electrostatic charge is given to a photoconductive plate formed of a photoconductive material, such as selenium, by a corona discharge in a dark location. When this is exposed corresponding to the original image, the charge is changed only where it is exposed to light, and a latent image is formed. If a toner, which is oppositely charged to this latent image, is then introduced by subjecting a carrier to bear the toner, the toner will adhere to the photoconductive plate in the shape of the image. A recording material is then applied thereon, and the toner is transferred to the recording material. The image is formed by fixing the transferred toner with heat or the like.

In recent years, color copiers using the aforesaid method with colored toners are becoming more common. This color copier is used in many cases to copy images rather than text. For this reason, the image formed must have properties approaching those of a silver halide photographic print, such as image quality (brilliance, sense of depth, superior distinction, sharpness), appearance (glossiness, homogeneity), texture (thickness, robustness, pleasant touch), handling properties (light resistance, dark storage property, water resisting property) and physical strength (anti-adhesion properties, scratch resistance, curl and tearing). Furthermore, higher added value than that of a film photo print is required due to technological developments, for example, double-sided output, back surface writing property, and the like.

SUMMARY OF THE INVENTION

It is therefore an object of the present invention to provide an electrophotographic image-receiving sheet which can form high quality images with brilliance a sense of depth, superior distinction and high clarity, and a process for image formation using this electrophotographic image-receiving sheet.

The electrophotographic image-receiving sheet of the present invention comprises a support and a toner image-receiving layer on at least one surface of the support. A regular reflectance of a surface of the toner image-receiving layer at 440 nm and a regular reflectance of the surface of the toner image-receiving layer at 560 nm, are both 2% or more. Hence, an electrophotographic image-receiving sheet, which can form high quality images with brilliance, a sense of depth, superior distinction and high clarity, can be obtained.

The process for image formation of the present invention uses the electrophotographic image-receiving sheet of the present invention. A toner image is formed on a surface of the electrophotographic image-receiving sheet, then the toner image on the electrophotographic image-receiving sheet is heated and pressurized with a fixing belt and a fixing roller, and then cooled. Thereafter the electrophotographic image-receiving sheet is separated from the fixing belt. Even if an oil-less machine without fixing oil is used, therefore, peeling of toner or the electrophotographic image-receiving sheet, or offset of toner or the electrophotographic image-receiving sheet can be prevented, a stable paper feed can be realized, and a good image having unprecedented glossiness which is rich in photographic sense can be obtained.

BRIEF DESCRIPTION OF THE DRAWING

FIGURE is a schematic view showing an example of the fixing-belt device used in the process for image formation of the present invention.

DESCRIPTION OF THE PREFERRED EMBODIMENTS

The electrophotographic image-receiving sheet of the present invention comprises a support and a toner image-receiving layer, and other layers which may be suitably selected if required.

<Surface Physical Properties of Toner Image-receiving Layer and Support>

The surface physical properties of the aforesaid toner image-receiving layer (a surface protective layer, in case that the electrophotographic image-receiving sheet of the present invention has the surface-protective layer on the toner image-receiving layer surface, idem hereafter) will now be described. In the present invention, it is required for the regular reflectance of the surface at 440 nm and the regular reflectance of the surface at 560 nm to both be at least about 2% or more, preferably 3% or more, and more preferably, 4% or more.

If the regular reflectance is less than about 2%, images with exceptional brilliance, sense of depth, distinction and sharpness are not formed.

In the present invention, the above "regular reflectance" is a value calculated by the following equation (1).

$$\text{regular reflectance} = \text{spectral total reflectance} - \text{diffuse reflectance} \quad \text{equation (1)}$$

The surface physical properties of the toner image-receiving layer should be such that the regular reflectance of the surface at 440 nm, with respect to the diffusion reflectance of 100, is preferably about 3/100 or more, more preferably 4/100 or more, and still more preferably 5/100 or more.

If the ratio of the regular reflectance to the diffusion reflectance is less than about 3/100, images with exceptional brilliance, sense of depth, distinction and sharpness are not formed.

The support preferably have a regular reflectance at 440 nm and a regular reflectance at 560 nm of about 2% or more, more preferably 3% or more, and still more preferably, 4% or more, at least on the surface where the toner image-receiving layer is formed.

Thus, the toner image-receiving layer can be formed on a support whose regular reflectance of the surface at 440 nm and at 560 nm are both 2% or more. Hence, an electrophotographic image-receiving sheet which can form high quality images with brilliance, a sense of depth, distinction and high clarity, can be obtained.

<Preferred Components of the Toner Image-receiving Layer and Support or the Like>

It is particularly preferred that at least one of the toner image-receiving layer, the support, an undercoat layer described later and a surface protective layer (top coat layer) describe later, contains a metal oxide-cladded mica. By including the metal oxide-cladded mica in these layers, the desired surface physical properties are easily attained, and an electrophotographic image-receiving sheet which can form high quality images with brilliance, a sense of depth, superior distinction and high clarity, can be provided.

When the support is a polyolefin-coated sheet (in particular, a sheet coated on both sides with polyethylene) described later, it is preferred the polyolefin (in particular, polyethylene)-coating layer contains a metal oxide-cladded mica therein.

The average particle diameter (volume average particle diameter ($D_{50}$)) of the metal oxide-cladded mica is preferably about 2.0 μm or more, more preferably 3.0 μm or more, and still more preferably 4.0 μm or more.

When the average particle diameter lies within this numerical range, an electrophotographic image-receiving sheet which can form high quality images with brilliance, a sense of depth, superior distinction and high clarity, can be provided.

The aspect ratio of the metal oxide-cladded mica is preferably about 10 or more, more preferably 15 or more, and still more preferably 20 or more.

When the aspect ratio lies within this numerical range, an electrophotographic image-receiving sheet which can form high quality images with brilliance, a sense of depth, superior distinction and high clarity, can be provided.

The geometric thickness of the cladding layer in the metal oxide-cladded mica is preferably about 30 nm or more, more preferably 40 nm or more, and still more preferably 50 nm or more.

When the geometric thickness lies within this numerical range, an electrophotographic image-receiving sheet which can form high quality images with brilliance, a sense of depth, superior distinction and high clarity, can be provided.

The content of metal oxide-cladded mica in the toner image-receiving layer is preferably 0.1% by mass or more. The content of metal oxide-cladded mica in the undercoat layer is preferably 0.1% by mass or more. The content of metal oxide-cladded mica in the polyolefin-coated layer is preferably 0.5% by mass or more. Also, the content of metal oxide-cladded mica in the surface protective layer (top coat layer) is preferably 0.1% by mass or more.

When the contents lie within these numerical ranges, an electrophotographic image-receiving sheet which can form high quality images with brilliance, a sense of depth, superior distinction and high clarity, can be provided.

Preferred examples of the aforesaid metal oxide-cladded mica are titanium oxide-cladded mica, zirconium dioxide-cladded mica, tin dioxide-cladded mica, and cladded micas with oxides of iron, nickel, cobalt, chromium and aluminium. Of these, titanium oxide-cladded mica is particularly preferable from the viewpoint of providing an electrophotographic image-receiving sheet which can form high quality images with brilliance, a sense of depth, superior distinction and high clarity. These may be used singly, or in combination of two or more.

Support

There is no particular limitation on the support, provided that in addition to the aforesaid aspects, it can withstand the fixing temperature and satisfies the requirements of smoothness, whiteness, slidability, frictional properties, antistatic properties and depression after fixing, and it may be suitably selected according to the purpose. General examples of the support are photographic supports such as papers and synthetic polymers (films) described in, for example, "Fundamentals of Photographic Engineering: Silver Halide Photography", edited by the Society of Photographic Science and Technology of Japan, Corona Publishing Co. (1979), pp. 223–240.

Specific examples of the aforesaid support are paper supports made from synthetic papers (synthetic papers such as the polyolefinic type, polystyrene type or the like), high-quality paper, art paper, (double-side) coated paper, (double-side) cast coated paper, mixed papers from synthetic resin pulp, such as, polyethylene and natural pulp, Yankee paper, baryta paper, wallpaper, backing paper, synthetic resin or emulsion-impregnated paper, synthetic rubber latex-impregnated paper, synthetic resin added paper, cardboard, cellulose fiber paper, polyolefine-coated paper (in particular, paper coated on both sides with polyethylene), and the like; plastic films or sheets such as polyolefine, polyvinyl chloride, polyethylene terephthalate, polystyrene methacrylate, polyethylene naphthalate, polycarbonate polyvinyl chloride, polystyrene, polypropylene, polyimide, cellulose (for example, triacetyl cellulose), and the like; films or sheets obtained by treating these plastic films or sheets to give white reflection properties (for example, blending a pigment such as titanium oxide with the film); cloths; metals; glass; and the like.

These may be used singly, or in combination of two or more as a laminate. One or both sides may also be laminated with a synthetic polymer such as polyethylene.

Other examples of the support are given on pp. 29–31 of Japanese Patent Laid-Open (JP-A) No. 62-253,159, pp. 14–17 of JP-A No. 01-61,236, JP-A Nos. 63-316,848, 02-22, 651, and 03-56,955, and U.S. Pat. No. 5,001,033.

The thickness of the support is preferably 25 μm to 300 μm, more preferably 50 μm to 260 μm, and still more preferably 75 μm to 220 μm.

There is no particular limitation on the rigidity and smoothness of the support which can be suitably selected according to the purpose, but for an image-receiving sheet of photographic quality, it is preferred that these properties approach those of a support of a color silver halide photograph.

The density of the support is preferably 0.7 g/cm$^3$ or more from the viewpoint of fixing properties.

There is no particular limitation on the heat conductivity of the support which can be suitably selected according to the purpose, but it is preferably 0.50 kcal/m·h·° C. or more under the relative humidity of 65% at 20° C., from the viewpoint of fixing properties.

The heat conductivity of the electrophotographic toner image-receiving sheet humidified by the method based on JIS P 8111 can be measured by the method disclosed in JP-A No. 53-66279.

In addition to the aforesaid metal oxide-cladded mica, various additives suitably selected within limits, which do not impair the effect of the present invention, can be added to the support according to the purpose.

Examples of such additives are whiteners, electroconducting agents, fillers, and pigments or dyes such as titanium oxide, ultramarine blue, carbon black and the like.

It is preferable to perform various surface treatments on one side or both sides of the support, or to form an undercoat layer thereon in order to improve adhesion with laminated layers thereon.

Examples of such surface treatment are printing of a glossy surface, the fine surface described in JP-A No. 55-26507, a matte surface, a silk surface, or the like;

activation treatments such as corona discharge treatment, flame treatment, glow discharge treatment, plasma treatment, or the like.

The method of forming the undercoat layer has no limitation and any known method in the art can be suitably used.

These treatments and lamination may be performed independently, or the activation treatment can be performed after the printing, or the undercoat layer can be formed after surface treatments such as the activation treatment, and these treatments can be combined as desired.

A hydrophilic binder, semiconductor metal oxide such as alumina sol, tin oxide, and the like, and carbon black or another antistatic agent, may be applied to the support, or onto the top or undersurface of the support, or in combination thereof. Examples of such supports are described in JP-A No. 63-220,246.

Toner Image-receiving Layer

The toner image-receiving layer receives at least one of color toner and black toner, and an image is formed thereon.

There is no particular limitation on the material of the toner image-receiving layer which may be selected according to the purpose. The material is, for example, an image-receiving substance which can accept toner to form an image from a developing drum or an intermediate transfer body by the action of a (static) electric charge or pressure in a transfer step, and can fix the image by heat or pressure in a fixing step.

Examples of the image-receiving substance are thermoplastic resins, water-soluble resins, pigments and the like.

The thickness of the toner image-receiving layer is preferably ½ or more, more preferably 1 to 3 times, of the particle diameter of the toner.

The thickness of the toner image-receiving layer is preferably that described in JP-A Nos. 05-216322 and 07-301939.

In addition to the aforesaid surface properties, the physical properties of the toner image-receiving layer preferably satisfy one or more of the following, more preferably two or more of the following, and still more preferably all of the following items.

(1) Tg (glass transition temperature) of the toner image-receiving layer is preferably 30° C. or more, and less than Tg of the toner plus 20° C.
(2) T½ (a softening point measured by ½ method) of the toner image-receiving layer is preferably 60° C. to 200° C., and more preferably 80° C. to 170° C.
(3) Tfb (flow beginning temperature) of the toner image-receiving layer is preferably 40° C. to 200° C., and is preferably less than Tfb of the toner plus 50° C.
(4) The temperature at which the viscosity of the toner image-receiving layer is $1\times10^5$ CP, is preferably 40° C. or more, and lower than that of the toner.
(5) The storage elastic modulus (G') of the toner image-receiving layer at fixing temperature is preferably $1\times10^2$ Pa to $1\times10^5$ Pa, and the loss elastic modulus (G") of the toner-image-receiving layer at fixing temperature is preferably $1\times10^2$ Pa to $1\times10^5$ Pa.
(6) The loss tangent (G"/G'), which is the ratio of the loss elastic modulus (G") and storage elastic modulus (G') of the toner image-receiving layer at the fixing temperature, is preferably 0.01 to 10.
(7) The storage elastic modulus (G') of the toner image-receiving layer at the fixing temperature is preferably within the range of −50 to +2500 with respect to the storage modulus (G") of the toner at the fixing temperature.
(8) The inclination angle of fused toner on the toner image-receiving layer is preferably 50° or less, and more preferably 40° or less.

The toner image-receiving layer preferably satisfies the physical properties disclosed in Japanese Patent (JP-B) No. 2788358, and JP-A Nos. 07-248637, 08-305067 and 10-239889.

The physical properties of (1) can be measured with a differential scanning calorimetry apparatus (DSC). The physical properties of (2) and (3) can be measured using a Flow Tester CFT-500 manufactured by Shimadzu Corporation. The physical properties of (5) through (7) can be measured using a rotating type rheometer (for example, a dynamic analyzer RADII manufactured by Rheometric Scientific). The physical properties of (8) can be measured using the Contact Angle Measurement Apparatus manufactured by Kyowa Interface Science Co., LTD according to the method disclosed by JP-A No. 08-334916.

Thermoplastic Resin

There is no particular limitation on the thermoplastic resin which may be selected according to the purpose provided that it can change its shape at the fixing temperature and receive toner, but it is preferably the same as the binder resin of the toner. Toners commonly contain a polyester resin, styrene or a copolymer resin such as styrene-butylacrylate copolymer. In this case, it is preferable to use a polyester resin, styrene, or a copolymer resin such as styrene-butylacrylate copolymer also as the thermoplastic resin used for the electrophotographic image-receiving sheet. It is more preferable to use 20% by mass or more of the polyester resin, styrene or a copolymer resin such as styrene-butylacrylate copolymer. Styrene, styrene-butylacrylate copolymer, styrene-acrylic ester copolymer and styrene-methacrylic ester copolymer are also preferred.

Specific examples of the thermoplastic resin are (a) resins containing ester bonds, (b) polyurethane resins, (c) polyamide resins, (d) polysulfone resins, (e) polyvinyl chloride resins, (f) polyvinyl butyral, (g) polycaprolactone resins, (h) polyolefin resins, and the like.

Examples of (a) resins containing ester bonds are polyester resins obtained by condensation of a dicarboxylic acid component, such as terephthalic acid, isophthalic acid, maleic acid, fumaric acid, phthalic acid, adipic acid, sebacic acid, azelaic acid, abietic acid, succinic acid, trimellitic acid and pyromellitic acid (in these dicarboxylic acid components, a sulfonic acid group and a carboxyl group may be substituted), with an alcohol component such as ethylene glycol, diethylene glycol, propylene glycol, bisphenol A, diether derivative of bisphenol A (e.g., ethyleneoxide diaddition product of bisphenol A, propylene oxide diaddition product of bisphenol A), bisphenol S, 2-ethyl cyclohexyl dimethanol, neopentyl glycol, cyclohexyldimethanol and glycerol (in these alcohol components, a hydroxyl group may be substituted); polyacrylate resins or polymethacrylate resins, such as polymethylmethacrylate, polbutylmethacrylate, polymethyl acrylate and polybutylacrylate; polycarbonate resins; polyvinyl acetate resins; styrene acrylate resins; styrene-methacrylic ester copolymer resins; vinyltoluene acrylate resins; and the like. Specific examples are given in JP-A Nos. 59-101395, 63-7971, 63-7972, 63-7973 and 60-294862.

Commercial products of the aforesaid polyester resins are Bylon 290, Bylon 200, Bylon 280, Bylon 300, Bylon 103, Bylon GK-140 and Bylon GK-130 from Toyobo Co., Ltd; Tufton NE-382, Tufton U-5, ATR-2009 and ATR-2010 from Kao Corporation; Eritel UE3500, UE3210 and XA-8153 from Unitika Ltd.; Polyester TP-220, R-188 from The Nippon Synthetic Chemical Industry Co., Ltd.

Commercial products of the aforesaid acrylic resins are SE-5437, SE-5102, SE-5377, SE-5649, SE-5466, SE-5482, HR-169, 124, HR-1127, HR-116, HR-113, HR-148, HR-131, HR-470, HR-634, HR-606, HR-607, LR-1065, 574, 143, 396, 637, 162, 469, 216, BR-50, BR-52, BR-60, BR-64, BR-73, BR-75, BR-77, BR-79, BR-80, BR-83, BR-85, BR-87, BR-88, BR-90, BR-93, BR-95, BR-100, BR-101, BR-102, BR-105, BR-106, BR-107, BR-108, BR-112, BR-113, BR-115, BR-116, BR-117 from Mitsubishi Rayon Ltd.; Esrec P SE-0020, SE-0040, SE-0070, SE-0100, SE-1010, SE-1035 from Sekisui Chemical Co., Ltd.; Himer ST95 and ST120 from Sanyo Chemical Industries, Ltd.; and FM601 from Mitsui Chemicals, Inc.

The polyvinyl chloride resins (e) mentioned above may for example be polyvinylidene chloride resins, vinyl chloride-vinyl acetate copolymer resins, vinyl chloride-vinyl propionate copolymer resins, and the like.

The polyvinyl butyral (f) mentioned above may be a cellulose resin such as a polyol resin, an ethyl cellulose resin, a cellulose acetate resin, or the like. Commercial products thereof are manufactured by Denki Kagaku Kogyo Kabushiki Kaisha and Sekisui Chemicals Ltd. The aforesaid polyvinyl butyral preferably contains 70% by mass or more of polyvinyl butyral, and preferably has an average polymerization degree of 500 or more, and more preferably an average polymerization degree of 1,000 or more. Commercial products thereof are Denka Butyral 3000-1, 4000-2, 5000A and 6000C from Denki Kagaku Kogyo Kabushiki Kaisha; and Esrec BL-1, BL-2, BL-3, BL-S, BX-L, BM-1, BM-2, BM-5, BM-S, BH-3, BX-1, BX-7 from Sekisui Chemicals Ltd.

Examples of the polycaprolactone resins (g) are styrene-maleic anhydride resins, polyacrylonitrile resins, polyether resins, epoxy resins, phenol resins, and the like.

Examples of the polyolefin resins (h) are polyethylene resins and polypropylene resins, copolymer resins of olefins such as ethylene and propylene with other vinyl monomers, and acrylic resins, and the like.

The aforesaid thermoplastic resins may be used singly or in combination of two or more, and in addition to this, their mixtures or copolymers may also be used.

It is preferred that the thermoplastic resin satisfies the physical properties of the toner image-receiving layer in the form of the toner image-receiving sheet, more preferred that it satisfies the physical properties of the toner image-receiving layer in a form of the resin itself, and also preferred that two or more resins giving different physical properties to the toner image-receiving layer are used in combination.

It is preferred that the thermoplastic resin has a larger molecular weight than that of a thermoplastic resin used for the toner. However, this molecular weight relation may not always be desirable depending on the thermodynamic properties of the thermoplastic resin used for the toner and the resin used for the toner image-receiving layer. For example, if the softening temperature of the resin used for the toner image-receiving layer is higher than that of the thermoplastic resin used for the toner, it is preferred that the molecular weights are equal, or that the molecular weight of the resin used for the toner image-receiving layer is smaller.

It is also preferred that the thermoplastic resin used is a mixture of resins with identical compositions having different average molecular weights. The relation with molecular weights of thermoplastic resins used as toners is disclosed in JP-A No. 08-334915.

The molecular weight distribution of the thermoplastic resin is preferably wider than the molecular weight distribution of the thermoplastic resin used in the toner.

It is preferred that the thermoplastic resin satisfies the physical properties disclosed in Japanese Patent Application Publication (JP-B) Nos. 05-127413, 08-194394, 08-334915, 08-334916, 09-171265 and 10-221877.

Water-soluble Resin

There is no particular limitation on the composition, molecular structure, molecular weight, molecular weight distribution and form of the water soluble resin provided that it is water-soluble, and it may be suitably selected according to the purpose. For example, those containing a polymeric water-soluble group are preferable.

Examples of this polymeric water-soluble group of are a sulfonic acid group, a hydroxyl group, a carboxyl group, a amino group, a amide group, a ether group, and the like.

Examples of the water-soluble resin are given in "Research Disclosure", No. 17,643, p 26, "Research Disclosure" No. 18,716, p 651, "Research Disclosure" No. 307,105, pp. 873–874, or JP-A No. 64-13546, pp. 71–75. Specific examples of the water-soluble resin are-vinyl pyrrolidone-vinyl acetate copolymer, styrene-vinyl pyrrolidone copolymer, styrene-maleic anhydride copolymer, water-soluble polyester, water-soluble polyurethane, water-soluble nylon, water-soluble epoxy resin, and the like.

Regarding this water-soluble resin, when the binder resin of the toner is a polyester resin, a water-dispersible polyester is preferably used as the resin in the toner image-receiving layer.

Other examples of the water-soluble resin are water-dispersible resins such as water-dispersible acrylic resin, water-dispersible polyester resin, water-dispersible polystyrene resin and water-dispersible urethane resin; emulsions such as acrylic resin emulsion, vinyl polyacetate emulsion and SBR (styrene butadiene rubber) emulsion; resins or emulsions in which a thermoplastic resin is dispersed in water; copolymers, mixtures and cationic derivatives thereof, or the like.

These may be used singly, or in combination of two or more.

Commercial products of these water-soluble resins are Byronal MD-1200, MD-1220, MD-1930 from Toyobo Co., Ltd; plus coats Z-446, Z-465, RZ-96 from GOO CHEMICAL CO., LTD.; ES-611, ES-670 from Dainippon Ink and Chemicals; Pethregin A-160P, A-210, A-620 from TAKAMATSU OIL&FAT CO., LTD; and High Loss XE-18, XE-35, XE-48, XE-60, XE-62 from SEIKO CHEMICAL INDUSTRIES CO., LTD.; Julimer AT-210, AT-510, AT-515, AT-613, ET-410, ET-530, ET-533, FC-60, FC-80 from NIHON JUNYAKU CO., LTD.

A preferable example of the water-soluble resin is gelatin. This gelatin may suitably be selected from among liming gelatin, acid-treated gelatin and deliming gelatin having a reduced calcium content, according to the purpose, and these may be used in combination.

The film-forming temperature of the aforesaid water-soluble resin is preferably room temperature or above, for pre-print storage, and preferably 100° C. or less, for fixing of toner particles.

Pigment

The pigment may be a florescent whitening agent, white pigment, colored pigment or dye in order to improve image quality and particularly whiteness.

The florescent whitening agent is a compound known in the art, which has absorption in the near-ultraviolet region, and emits fluorescence at 400 nm to 500 nm.

As this florescent whitening agent, the compounds described in "The Chemistry of Synthetic Dyes" Volume V, Chapter 8, edited by KVeenRataraman can preferably be mentioned. Specific examples of the florescent whitening agent are stilbene compounds, coumarin compounds, biphenyl compounds, benzo-oxazoline compounds, naphthalimide compounds, pyrazoline compounds, carbostyryl compounds, and the like. Examples of these are white furfar PSN, PHR, HCS, PCS, B from Sumitomo Chemicals, and UVITEX-OB from Ciba-Geigy.

The white pigment is an inorganic pigment (titanium oxide, calcium carbonate, etc) described in the section on the filler and the section on the pigment having the fine particle diameter.

Examples of the colored pigment are various pigments and azo pigments described in JP-A No. 63-44653, (e.g., azo lakes such as carmine 6B and red 2B; insoluble azo compounds such as mono-azo yellow, disazo yellow, pyrazolo orange and Balkan orange; and condensed azo compounds such as chromophthal yellow and chromophthal red), polycyclic pigments (e.g., phthalocyanines such as copper phthalocyanine blue and copper phthalocyanine green; thioxadines such as thioxadine violet; isoindolinones such as isoindolinone yellow; surenes such as perylene, perinon, hulavanthoron and thioindigo), lake pigments (Malachite Green, Rhodamine B, Rhodamine G and Victoria Blue B), or inorganic pigments (oxides, titanium dioxide and red ocher, sulfates such as precipitated barium sulfate, carbonates such as precipitated calcium carbonates, silicates such as water-containing silicates and anhydrous silicates, metal powders such as aluminum powder, bronze powder and zinc dust, carbon black, chrome yellow, Berlin blue and the like).

The pigment is preferably an inorganic pigment.

Examples of the inorganic pigment are a silica pigment, an alumina pigment, a titanium dioxide pigment, a zinc oxide pigment, a zirconium oxide pigment, a micaceous iron oxide, lead white, a lead oxide pigment, a cobalt oxide pigment, strontium chromate, a molybdenum pigment, smectite, a magnesium oxide pigment, a calcium oxide pigment, a calcium carbonate pigment, mullite and the like. Of these, the silica pigment and the alumina pigment are preferred. These may be used singly, or in combination of two or more.

Examples of the silica pigment include spherical silica and amorphous silica.

The silica pigment can be synthesized by the dry method, wet method or the air blower method. The hydrophobic silica particles may also be surface-treated with a trimethyl silyl group or silicone. Of these, colloidal silica is preferable.

The average particle diameter of the silica pigment, although the preferred ranges differ, is preferably 4 nm to 120 nm, and more preferably 4 nm to 90 nm from the viewpoint of imparting whiteness.

The silica pigment is preferably a porous silica pigment. The average pore diameter of this porous silica pigment is preferably 50 nm to 5,000 nm. Moreover, the average pore volume per mass of this porous silica pigment is preferably 0.5 ml/g to 3 ml/g.

The alumina pigment contains anhydrous alumina and hydrated alumina. The crystalline type of the anhydrous alumina may be $\alpha$, $\beta$, $\gamma$, $\delta$, $\zeta$, $\eta$, $\theta$, $\kappa$, $\rho$ or $\chi$. The hydrated alumina is more preferable than the anhydrous alumina. The hydrated alumina may be monohydrate or trihydrate. The monohydrate contains pseudoboehmite, boehmite and diaspore. The trihydrate contains gibsite and bayerite.

The average particle diameter of the alumina pigment is preferably 4 nm to 5,000 nm, and more preferably 4 nm to 200 nm from the viewpoint of imparting whiteness.

This alumina pigment is preferably porous alumina. The average pore diameter of this porous alumina pigment is particularly preferably 100 nm to 5,000 nm. The average pore volume per mass of this porous alumina pigment is preferably 0.3 ml/g to 3 ml/g.

The hydrated alumina may be synthesized by the sol-gel method in which ammonia is added to an aluminium salt solution so as to precipitate, or by the method of hydrolyzing an alkali aluminate. The anhydrous alumina can be obtained by dehydrating hydrated alumina with heating.

The used amount of the aforesaid inorganic pigment is preferably 5 parts by mass to 2,000 parts by mass in terms of dry mass ratio, relative to the binder in the added layer.

The toner image-receiving layer may contain additives which are suitably selected for the purpose of improving thermodynamic properties.

There is no limitation on the additives which may be suitably selected according to the purpose. Examples thereof are a plasticizer, filler, a crosslinking agent, a charge control agent, an electroconducting agent, a surfactant, a dye, a humidifying agent, a matting agent and the like.

The plasticizer may be any plasticizer known in the art. The plasticizers referred to here are compounds which regulate flexibility or softening of the toner image-receiving layer due to heat and/or pressure when the toner is fixed.

Specific examples of the plasticizer are given in "Chemistry Handbook" (ed. Chemical Society of Japan, Maruzen), "Plasticizers—Their Theory and Application-" (ed. Koichi Murai, Saiwai Shobo), "Plasticizer Research, I" and "Plasticizer Research, II", (Polymer Chemistry Association) and "Handbook of Rubber and Plastic Chemical Mixtures" (ed. Rubber Digest). The specific example thereof also includes esters, (for example phthalic acid esters, phosphate esters, fatty acid esters, abietic acid esters, adipic acid esters, sebacic acid esters, azeleic acid esters, benzoic acid esters, butyric acid esters, epoxy fatty acid esters, glycolic acid esters, propionic acid esters, trimellitic acid esters, citric acid esters, sulfonic acid esters, carboxylic acid esters, succinic acid esters, maleic acid esters, fumaric acid esters, phthalic acid esters and stearic acid esters), amides (for example, fatty acid amide and sulfoamides), ethers, alcohols, paraffins, polyolefin waxes (for example, polypropylene waxes and polyethylene waxes), lactones, polyethyleneoxy compounds, silicone oils and fluorine compounds, as mentioned in JP-A Nos. 59-83154, 59-178451, 59-178453, 59-178454, 59-178455, 59-178457, 62-174754, 62-245253, 61-209444, 61-200538, 62-8145, 62-9348, 62-30247, 62-136646, 62-174754, 62-245253, 61-209444, 61-200538, 62-8145, 62-9348, 62-30247, 62-136646, and 02-235694.

The plasticizer may have a relatively low molecular weight. In this case, the molecular weight of the plasticizer is preferably lower than the molecular weight of the resin in which the plasticizer is to be contained, more preferably 15,000 or less, and still more preferably 8,000 or less.

The plasticizer may be a polymeric plasticizer. In this case, the plasticizer is preferably a similar polymer to the resin in which the plasticizer is to be contained. For example, polyester is preferred for the plasticizer of a polyester resin. Moreover, an oligomer may also be used as the plasticizer.

Examples of the plasticizer, apart from the above-listed, are the commercial products such as Adecasizer PN-170, PN-1430 from Asahi Denka Kogyo; PARAPLEX-G-25, G-30, G-40 from C. P. HALL; and ester gum 8L-JA, ester R-95, pentalin 4851, FK 115, 4820, 830, Luisol 28-JA, Picolastic A75, Picotex LC and Cristallex 3085 from Rika Hercules.

The plasticizer is added to at least one layer of the component layers including the toner image-receiving layer, on the support. Examples of the component layers are a protective layer, an interlayer and an undercoat layer, and the like. It is preferred that it is a layer to which the stress produced when the toner is incorporated in the toner image-receiving layer, is transmitted, more preferred that it is a layer to which distortion produced due to the stress (physical distortion such as elastic force or viscous properties, or distortion due to material input/output such as molecules, binder main chains or pendant parts) is transmitted, and particularly preferred that it is a layer situated in a position which can mitigate these stresses or distortions, for example, the layer adjacent to the toner image-receiving layer, the toner image-receiving layer or the surface protective layer.

The plasticizer may be in a micro-dispersed state or in a phase-microseparation state such as domains in a phase, and maybe thoroughly mixed and dissolved in other components such as the binder, in these layers to which it is added.

When the total mass of the resin forming the layers, the other components and the plasticizer is 100 parts by mass, the addition amount of plasticizer is preferably 0.001 part by mass by mass to 200 parts by mass, more preferably 0.1 part by mass to 100 parts by mass, and still more preferably 1 part by mass to 50 parts by mass.

The plasticizer may also be added with the object of regulating slide properties (improvement of transport properties by decreasing friction), improvement of fixing part offset (separation of toner or layers from fixing part), regulation of curl balance and charge regulation (formation of toner electrostatic image).

The filler may be filler known in the art as a strengthening agent, a filling agent or a strengthening material for a resin, organic and inorganic fillers being preferred.

Examples of the filler may be selected from "Handbook of Rubber and Plastic Chemical Mixtures" (ed. Rubber Digest), "Plastic Blending Agents, Fundamentals and Application", new edition (Taisei Co.) and "The Filler Handbook" (Taisei Co.).

The filler may for example be an inorganic pigment. Examples of the inorganic pigment are any known pigments in the art such as titanium oxide, calcium carbonate, silica, talc, mica, alumina and others described in "Handbook of Rubber and Plastic Chemical Mixtures" (ed. Rubber Digest).

The crosslinking agent may be a compound having two or more epoxy groups, isocyanate groups, aldehyde groups, active halogen groups, active methylene groups, acetylenic groups or other reactive groups known in the art, as reactive groups. Compounds having two or more groups which can form bonds by hydrogen bonding, ionic bonding or coordinate bonding may also be mentioned as examples thereof.

The crosslinking agent may be a known compound such as a coupling agent, a curing agent, a polymerization agent, a polymerization promoter, a coagulant, a film-forming agent, a film-forming promoter for a resin and the like. Examples of the coupling agent are chlorosilanes, vinylsilanes, epoxysilanes, aminosilanes, alkoxy aluminium chelates and titanate coupling agents, and those disclosed in "Handbook of Rubber and Plastic Chemical Mixtures" (ed. Rubber Digest).

The charge control agent may be added for the purpose of regulating toner transfer and adhesion, and preventing electrostatic adhesion of the electrophotographic image-receiving sheet. The charge control agent may be any antistatic agent or charge control agent known in the art, such as a cationic surfactant, an anionic surfactant, an amphoteric surfactant or a non-ionic surfactant, a polymer electrolyte, or an electroconductive metal oxide.

Examples of the charge control agent are cationic antistatic agents such as quaternary ammonium salts, polyamine derivatives, cation-modified polymethyl methacrylate and cation-modified polystyrene; anoinic antistatic agents such as alkyl phosphates or anionic polymers; or non-ionic antistatic agents such as fatty acid esters or polyethylene oxide. The examples are not limited thereto.

When the toner carries a negative charge, the charge control agent is preferably cationic or non-ionic.

Examples of the electroconducting agents are metal oxides such as ZnO, $TiO_2$, $SnO_2$, $Al_2O_3$, $In_2O_3$, $SiO_2$, MgO, BaO, $MoO_3$, and the like. These may be used singly, or in combination of two or more. The metal oxides may further contain other elements. For example, Al and In can be contained (doped) in ZnO, Nb and Ta can be contained (doped) in $TiO_2$, and Sb, Nb and halogens can be contained (doped) in $SnO_2$.

The dye may be various dyes known in the art, for example an oil-soluble dye.

Examples of the oil-soluble dye are anthraquinone compounds and azo compounds.

Specific examples of the oil-soluble dye are vat dyes such as C.I.Vat violet 1, C.I.Vat violet 2, C.I.Vat violet 9, C.I.Vat violet 13, C.I.Vat violet 21, C.I.Vat blue 1, C.I.Vat blue 3, C.I.Vat blue 4, C.I.Vat blue 6, C.I.Vat blue 14, C.I.Vat blue 20 and C.I.Vat blue 35; disperse dyes such as C.I. disperse violet 1, C.I. disperse violet 4, C.I. disperse violet 10, C.I. disperse blue 3, C.I. disperse blue 7 and C.I. disperse blue 58; and solvent dyes such as C.I. solvent violet 13, C.I. solvent violet 14, C.I. solvent violet 21, C.I. solvent violet 27, C.I. solvent blue 11, C.I. solvent blue 12, C.I. solvent blue 25 and C.I. solvent blue 55; and the like. Colored couplers used in silver halide photography may also be used to advantage.

Other Layers

The other layers mentioned above are a surface protective layer (top coat layer), an interlayer, an undercoat layer, a cushion layer, a charge control (inhibiting) layer, a reflecting layer, a tint adjusting layer, a storage ability improving layer, an anti-adhering layer, an anti-curl layer, a smoothing layer, a back coat layer, a non-moisture permeability layer, an adhesion improving layer, and the like. These layers may be monolayer structures, or laminated structures.

In the present invention, an aspect that the undercoat layer is provided on the support, an aspect that the undercoat layer is provided on the support coated with polyolefin, and an aspect that the surface protective layer (top coat layer) is provided on the toner image-receiving layer surface, are particularly preferable. In the present invention, from the viewpoint of effectively providing an electrophotographic image-receiving sheet which can form high quality images with brilliance, a sense of depth, superior distinction and high clarity, it is particularly preferred to include the metal oxide-cladded mica in this undercoat layer, polyolefin coating and finishing layer, as well as in the case of the support and toner image-receiving layer.

It is preferred that a surface-protective layer is provided on the toner-receiving layer surface from the viewpoint of surface protection, improvement of storage ability, improvement of handling properties, imparting writing properties, improvement of instrument permeability and imparting anti-offset properties, as described above. The surface protective layer may have a mono-layer structure, or laminated structure having two or more layers. Various thermoplastic resins, thermosetting resins or water-soluble polymers may be used as a binder for the surface protective layer, and this is preferably identical to that used for the toner image-receiving layer. However, it is not necessary for the thermodynamic properties and electrostatic properties to be identical to those of the toner image-receiving layer, and these can be optimized.

In addition to the metal oxide-cladded mica, all the additives used in the toner image-receiving layer may be suitably used for the surface protective layer. A charge control agent, matting agent, sliding agent and mold lubricant are preferably used. These can also be used for layers apart from the aforesaid protective layer.

From the viewpoint of fixing properties, it is preferred that the surface layer of the electrophotographic image-receiving sheet, such as a surface protective layer or the like, has good compatibility with the toner, and specifically preferred that the contact angle with fused toner is 0° to 40°.

There is no particular limitation on the matting agent which may be suitably selected according to the purpose, for example solid particles may be mentioned.

The solid particles may be classified as inorganic particles and organic particles.

Examples of the inorganic particles are oxides (e.g., silicon dioxide, titanium oxide, magnesium oxide, aluminium oxide), alkaline earth metal salts (e.g., barium sulfate, calcium carbonate, magnesium sulfate), silver halides (e.g., silver chloride, silver bromide), glass, and the like.

Examples of the inorganic particles are given in German Patent No.2529321, UK Patent Nos.760775, and 1260772, and U.S. Pat. Nos. 1,201,905, 2,192,241, 3,053,662, 3,062,649, 3,257,206, 3,322,555, 3,353,958, 3,370,951, 3,411,907, 3,437,484, 3,523,022, 3,615,554, 3,635,714, 3,769,020, 4,021,245, and 4,029,504.

Examples of the organic particles are starch, cellulose esters (e.g. cellulose acetate propionate), cellulose ethers (e.g., ethyl cellulose), synthetic resins, and the like.

The synthetic resin is preferably insoluble in water or hard to soluble in water. Examples of the synthetic resins which are insoluble in water or hard to soluble in water, are poly(meth)acrylic esters (for example, polyalkyl(meth) acrylate, polyalkoxyalkyl(meth)acrylate, polyglycidyl (meth)acrylate), poly(meth)acrylamide, polyvinyl esters (for example, polyvinyl acetate), polyacrylonitrile, polyolefins (for example, polyethylene), polystyrene, benzoguanamine resin, formaldehyde condensation polymers, epoxy resins, polyamides, polycarbonate, phenol resins, polyvinyl carbazole, polyvinylidene chloride, and the like.

The synthetic resin may be a copolymer which combines the repeating units of these polymers. The copolymer may also contain a small amount of a hydrophilic repeating unit. Examples of monomers forming the hydrophilic repeating unit are acrylic acid, methacrylic acid, α, β-unsaturated dicarboxylic acids, hydroxyalkyl(meth)acrylates, sulfoalkyl (meth)acrlyates, styrene sulfonic acid, and the like.

Examples of the organic particles are given in UK Patent No. 1055713, U.S. Pat. Nos. 1,939,213, 2,221,873, 2,268,662, 2,322,037, 2,376,005, 2,391,181, 2,701,245, 2,992,101, 3,079,257, 3,262,782, 3,443,946, 3,516,832, 3,539,344, 3,591,379, 3,754,924, 3,767,448, and JP-A Nos. 49-106821, and 57-14835.

The solid particles may be used singly, in combination of two or more. The average particle diameter of the solid particles is preferably 1 μm to 100 μm, and more preferably 4 μm to 30 μm. The usage amount of the solid particles is preferably 0.01 g/m$^2$ to 0.5 g/m$^2$, and more preferably 0.02 g/m$^2$ to 0.3 g/m$^2$.

The sliding agent may be various agents known in the art, for example higher alkyl sodium sulphates, higher fatty acid-higher alcohol esters, carbowax, higher alkyl phosphates, silicone compounds, denatured silicones, hardening silicone and the like. Polyolefine wax, fluorine oils, fluorine wax, carnauba wax, microcrystalline wax and silane compounds may also be mentioned as example thereof.

Examples of the sliding agent are given in U.S. Pat. Nos. 2,882,157, 3,121,060, 3,850,640, French Patent No. 2180465, UK Patent Nos. 955061, 1143118, 1263722, 1270578, 1320564, 1320757, 2588765, 2739891, 3018178, 3042522, 3080317, 3082087, 3121060, 3222178, 3295979, 3489567, 3516832, 3658573, 3679411, 3870521, and JP-A Nos. 49-5017, 51-141623, 54-159221, 56-81841, and Research Disclosure No. 13969.

There is no particular limitation on the usage amount of sliding agent which can be suitably selected according to the purpose, but it is preferably 30 mg/m$^2$ to 3,000 mg/m$^2$ and more preferably 100 mg/m$^2$ to 1,500 mg/m$^2$.

In so-called oil-less fixing which does not use oil for preventing offset to the fixing-part material in the fixing part, the usage amount of the sliding agent is preferably 5 mg/m$^2$ to 500 mg/m$^2$, and more preferably 10 mg/m$^2$ to 200 mg/m$^2$.

Of the aforesaid sliding agents, wax do not easily dissolve in an organic solvent, so it is preferable to prepare a water-dispersion wax, and a dispersion of the thermoplastic resin solution and the water-dispersion wax, then is applied. In this case, the wax sliding agent is present in the form of fine particles in the aforesaid thermoplastic resin. In this case, the usage amount of this sliding agent is preferably 5 mg/m$^2$ to 10,000 mg/m$^2$, and more preferably 50 mg/m$^2$ to 5,000 mg/m$^2$.

The back coat layer is provided on the opposite side of the toner image-receiving layer via the support with the object of imparting undersurface output compatibility, undersurface output image quality improvement, curl balance improvement, writing properties, compatibility with inkjets and other printing mechanisms, and machine transport property improvement.

When the electrophotographic image-receiving sheet is a transparent, it is preferable that the back coat layer is also transparent. When it is a reflecting type, there is no necessity that the back coat layer is transparent and may be in any color. In the case of the double-sided output type which forms an image also on the back, the back coat layer is preferably in white. In addition, the whiteness and spectral reflectance on the back surface in this case is preferably 85% or more, as in the case of the top surface.

The composition of the back coat layer may be the same as that of the toner-image receiving layer side so as to improve double-sided output compatibility. Various additives may be added to this back coat layer, the matting agents, sliding agents and charge control agents being particularly preferred. The back coat layer may have a single-layer structure, or laminated structure having two or more layers.

Moreover, when mold-release oil is used for the fixing roller, it is preferable to give oil absorptivity to the back surface to prevent offset at the time of fixing.

The adhesion improvement layer may suitably be provided to improve adhesion between the support, toner image-receiving layer and other layers.

Various kinds of additives can be used for this adhesion improvement layer, the aforesaid crosslinking agents can be preferably used.

The cushion layer may suitably be provided in order to improve toner receiving properties.

The non-moisture permeability layer is provided in order to reduce environmental humidity dependence during the pre-output storage state, during output and in the post-output printed state.

<Other Components of the Electrophotographic Image-receiving Sheet>

The electrophotographic image-receiving sheet of the present invention can be made to contain various kinds of additives for the purpose of improving the stability of the output image, and improving the stability of the toner image-receiving layer itself.

Examples of such additives are antioxidants, age resistors, ultraviolet light absorbers, metal complexes, light stabilizers, deterioration inhibitors, anti-ozonants, antiseptics and antifungals known in the art.

Examples of the antioxidants are chroman compounds, coumarane compounds, phenol compounds (e.g., hindered phenols), hydroquinone derivatives, hindered amine derivatives, spiroindan compounds and the like. Antioxidants are given for example in JP-A No. 61-159644.

Examples of the age resistors are given in "Handbook of Rubber and Plastics Additives", Second Edition (1993, Rubber Digest Co.), pp. 76–121.

Examples of the ultraviolet light absorbers are benzotriazo compounds (U.S. Pat. No. 3,533,794), 4-thiazolidone compounds (U.S. Pat. No. 3,352,681), benzophenone compounds UP-A No. 46-2784), ultraviolet light absorbing polymers (1P-A No. 62-260152), and the like.

Examples of the metal complexes are given in U.S. Pat. Nos. 4,241,155, 4,245,018, 4,254,195, and JP-A Nos. 61-88256, 62-174741; 63-199248, 01-75568, 01-74272, and the like.

The ultraviolet light absorber and light stabilizer may preferably be those described in "Rubber and Plastic Chemical Mixtures", Rev. 2 (1993, Rubber Digest, pp.122–137).

The electrophotographic image-receiving sheet of the present invention may also contain additives known in the art as photographic additives.

Examples of the photographic additives are given in the Journal of Research Disclosure (hereafter referred to as RD) No. 17643 (December 1978), No. 18716 (November 1979) and No. 307105 (November 1989), the relevant sections being summarized below.

| Type of additive | RD17643 | RD18716 | RD307105 |
|---|---|---|---|
| 1. Whitener | p 24 | p 648 right column | p 868 |
| 2. Stabilizer | pp. 24–25 | p 649 right column | pp. 868–870 |
| 3. Light absorber (ultraviolet light absorber) | pp. 25–26 | p 649 right column | p 873 |
| 4. Pigment image stabilizers | p 25 | p 650 right column | p 872 |
| 5. Film hardening agents | p 26 | p 651 left column | pp. 874–875 |
| 6. Binders | p. 26 | p 651 left column | pp. 873–874 |
| 7. Plasticizer, lubricants | p 27 | p 650 right column | p 876 |
| 8. Coating assistants (surfactants) | pp. 26–27 | p 650 right column | pp. 875–876 |
| 9. Antistatic agents | p 27 | p 650 right column | pp. 876–877 |
| 10. Matting agents | | | pp. 878–879 |

<Physical Properties of Electrophotographic Image-receiving Sheet>

It is preferable that, in the aforesaid electrophotographic image-receiving sheet, the whiteness of the surface where the toner image is formed, is high. Regarding the whiteness, the L* value is preferably 80 or higher, preferably 85 or higher and still more preferably 90 or higher in a CIE 1976 (L*a*b*) color space. The tone of the white color should preferably be as neutral as possible. Regarding the whiteness tone, the value of $(a^*)^2+(b^*)^2$ is preferably 50 or less, more preferably 18 or less and still more preferably 5 or less in a (L*a*b*) space.

Regarding the whiteness of the electrophotographic image-receiving sheet, it is preferred that a value measured by the method described in JIS P 8123 is 85% or higher, preferred that the spectral reflectance within the wavelength range of 440 nm to 640 nm is 85% or higher, and that the difference between the maximum spectral reflectance and minimum spectral reflectance within this wavelength range is within 5%, and more preferred that the spectral reflectance within the wavelength range of 400 nm to 700 nm is 85% or higher, and the difference between the maximum spectral reflectance and minimum spectral reflectance within this wavelength range is within 5%.

When the toner image-receiving layer is transparent, the optimum surface electrical resistance of the toner image-receiving layer is of the order of $10^{10}$ Ω/cm$^2$ to $10^{13}$ Ω/cm$^2$, and preferably $5\times10^{10}$ Ω/cm$^2$ to $5\times10^{12}$ Ω/cm$^2$. The addition amount of antistatic. agent is determined according to this.

The surface electrical resistance of the surface of the support opposite to the toner image-receiving layer is normally of the order of $5\times10^{8}$ Ω/cm$^2$ to $3.2\times10^{10}$ Ω/cm$^2$, and preferably $1\times10^{9}$ Ω/cm$^2$ to $1\times10^{10}$ Ω/cm$^2$. The surface electrical resistance is measured according to JIS K 6911, after humidifying a sample at a temperature of 20° C. and humidity of 65% for 8 hours or more, then passing a current for one minute using an Advantest R8340 with an applied voltage of 100V.

It is preferred that the glossiness of the toner image-forming surface of the electrophotographic image-receiving sheet is high. The glossiness over the whole region from the white area where there is no toner to the black area where there is maximum toner density is preferably 45° or higher, more preferably 60° or higher, still more preferably 75° or higher and most preferably 90° or higher. However, the upper limit of glossiness is preferably 110°. If the glossiness is more than 110°, a metallic gloss is obtained which is undesirable for the image.

The glossiness can be measured based on JIS Z 8741.

It is preferred that the smoothness of the toner image-forming surface of the electrophotographic image-receiving sheet is high. Regarding smoothness, it is also preferred that over the whole region from the white area where there is no toner to the black area where there is maximum toner density, the arithmetic average roughness (Ra) is preferably 3 μm or less, more preferably 1 μm or less, and still more preferably 0.5 μm or less.

The arithmetic average roughness can be measured based on the JIS B 0601, B 0651, B 0652.

The toner image-receiving layer and other layers in the aforesaid electrophotographic image-receiving sheet preferably have a surface electrical resistance in the region of $1\times10^{6}$ to $1\times10^{15}$ (25° C., 65% RH).

If the surface electrical resistance is less than $1\times10^{6}$Ω, the toner amount is insufficient when toner is transferred to the toner image-receiving layer, and the density of the obtained toner image is low, whereas if it is more than $1\times10^{15}$Ω, more charge than required for transfer is produced, toner is not transferred sufficiently, image density falls, a static charge builds up during handling of the electrophotographic image-receiving sheet so that dust tends to adhere, and misfeeds, double feeds, electric discharge marks and toner transfer losses easily occur during copying operation.

In the case of a transparent electrophotographic image-receiving sheet wherein the support is transparent and the aforesaid toner image-receiving layer is provided on the support, it is preferred that the layers on the support are also transparent. Also, in the case of a reflecting electrophotographic image-receiving sheet wherein the support is a reflecting layer and the toner image-receiving layer is provided on the support, the layers on the support are not necessarily transparent, and are preferably white.

The opaqueness of the electrophotographic image-receiving sheet is a value measured according to the method specified in JIS P 8138, and is preferably 85% or more, and more preferably 90% or more.

It is preferred that the electrophotographic image-receiving sheet does not adhere to the fixing and heating members during fixing. For this purpose, the 1800 peeling strength at the fixing temperature with the fixing member is preferably 0.1N/25 mm or less, and more preferably 0.041N/25 mm or less. The 180° peeling strength is measured based on the method disclosed in JIS 6887 using the surface material of the fixing member.

(Electrophotographic Color Toner)

The electrophotographic color toner used in the electrophotographic image-receiving sheet of the present invention may be obtained by any manufacturing method, such as the crushing method, suspension method, or the like.

The electrophotographic color toner obtained by the crushing method is manufactured by kneading, crushing and grading. The binder resin used for manufacturing the electrophotographic color toner obtained by this crushing method may be acids such as acrylic acid, methacrylic acid or maleic acid and its esters; a resin obtained by polymerization of a monomer such as polyester, polysulfonate, polyether, and polyurethane, or a resin obtained by copolymerization of two or more of these monomers. These binder resins are manufactured by thoroughly kneading together with a wax component and other toner component materials using a hot kneading machine such as a hot roller, kneader or extruder, mechanically crushing, and grading.

The electrophotographic color toner obtained by the crushing method contains approximately 0.1% by mass to 10% by mass, preferably 0.5% by mass to 7% by mass, of the wax component on the basis of mass of toner.

The electrophotographic color toner obtained by the suspension method is manufactured by kneading the binder resin, colorant and mold release agent (together with a magnetic material, charge control agent and other additives if necessary) in a solvent which is immiscible with water, and the obtained composition is coated with copolymer containing carboxyl groups. The obtained product is dispersed in an aqueous medium in the presence of a hydrophilic inorganic dispersant having a BET specific surface area of 10 $m^2/g$ to 50 $m^2/g$ and/or a viscosity regulating agent, diluting the suspension obtained with the aqueous medium if necessary. Thereafter, the obtained suspension is heated, and then the solvent is removed by heating and/or reduced pressure. According to the present invention, the electrophotographic toner obtained by the suspension method is preferred to the electrophotographic toner obtained by the crushing method.

The electrophotographic toner obtained by the suspension method may be any of the binder resins known in the art, for example, homopolymers and copolymers of, styrenes such as styrene, chlorostyrene; mono-olefins such as ethylene, propylene, butylene and isoprene; vinyl esters such as vinyl acetate, vinyl propionate, vinyl benzoate and vinyl butyrate; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; vinyl ethers such as vinyl methyl ether, vinyl ethyl ether and vinyl butyl ether; and vinyl ketones such as vinyl methyl ketone, vinyl hexyl ketone and vinyl isopropenyl ketone.

Specific examples of these binder resins are polystyrene resins, polyester resins, styrene-acrylate copolymers, styrene-methacrylate copolymers, styrene-acrylonitrile copolymers, styrene-butadiene copolymers, styrene-maleic anhydride copolymers, polyethylene resins or polypropylene resins, and polyurethane resins, epoxy resins, silicone resins, polyamide resins, modified rosin, paraffins and waxes. Of these, styrene-acrylic resins are particularly preferred.

The colorant contained in the aforesaid binder resin may be any of those known in the art. Examples thereof include carbon black, aniline blue, chalco oil blue, chrome yellow, ultramarine blue, Dupont oil red, quinoline yellow, methylene blue chloride, phthalocyanine blue, malachite green oxalate, lamp black, rose bengal, C.I. Pigment Red 48:1, C.I. Pigment Red 122, C.I. Pigment Red 57:1, C.I. Pigment Yellow 97, C.I. Pigment Yellow 12, C.I. Pigment Yellow 17, C.I. Pigment Blue 15:1, C.I. Pigment Blue 15:3, and the like.

The blending amount of the colorant is preferably 2% by mass to 8% by mass. If the blending amount of colorant is less than 2% by mass, the coloring is weak, and if the blending amount of colorant is more than 8% by mass, the transparency of the electrophotographic color toner is impaired.

The electrophotographic color toner may also comprise a mold release agent. The mold release agent is preferably wax, specific examples being low molecular weight polyolefins such as polyethylene, polypropylene, polybutene; aliphatic amides such as silicone resins softened by heat, olefinic amides, erucid acid amides, ricinoleic acid amides and stearic acid amides; vegetable wax such as carnauva wax, rice wax, candelila wax, tree wax and jojoba oil; animal wax such as bees wax; mineral/petroleum wax such as montan wax, ozocerite, ceresin, paraffin wax, microcrystalline wax and Fischer Tropsch wax, and their modifications. Regarding these mold release agents, if the wax used contains a low ester of high polarity such as carnauva wax or candelila wax, a large amount of wax is generally exposed on the toner particle surfaces, and conversely, if the wax is of low polarity such as polyethylene wax or paraffin wax, the exposure amount on the surface tends to decrease. Regardless of the exposure amount on the surface, the melting point of the wax is preferably 30° C. to 150° C., and more preferably 40° C. to 140° C.

The electrophotographic color toner is mainly formed from the aforesaid colorant and aforesaid binder resin, and its average particle diameter is of the order of 3 μm to 15 μm, and preferably 4 μm to 8 μm. Also, the storage elastic modulus G' (measured at an angular frequency of 10 rad/sec) when the temperature of the electrophotographic color toner itself is 150° C., is preferably 10 Pa to 200 Pa.

The electrophotographic color toner may also contain various additives. These additives may be inorganic fine powders and organic fine powders.

Examples of the inorganic fine powders are $SiO_2$, $TiO_2$, $Al_2O_3$, CuO, ZnO, $SnO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, $MgSO_4$, and the like.

Examples of the organic fine powders are aliphatic acids or their derivatives, fine powders of metal salts thereof, and resin powders such as fluorine resins, polyethylene resins and acrylic resins.

(Process for Image Formation)

The process for image formation, on the electrophotographic image-receiving sheet, of the present invention comprises the step of forming a toner image on a surface of electrophotographic image-receiving sheet, the step of heating and pressurizing the toner image on the surface of electrophotographic image-receiving sheet with a fixing belt and a fixing roller, the step of cooling the toner image on the surface of the electrophotographic image-receiving sheet, and the step of separating the electrophotographic image-receiving sheet from the fixing belt.

This process for image formation is implemented using an electrophotographic image-forming apparatus known in the art.

The image-forming apparatus comprises an electrophotographic image-receiving sheet transport unit, electrostatic latent image-forming unit, developing unit provided in proximity to the electrostatic latent image-forming unit and fixing unit, and depending on the machine, may also comprise an intermediate transfer unit in proximity to the electrostatic latent image-forming unit and electrostatic image-receiving sheet transport unit in the centre of the apparatus.

The intermediate transfer unit is provided in an intermediate belt transfer type image-forming apparatus wherein, instead of the toner image formed on the developing roller being transferred directly to the electrophotographic image-receiving sheet, the toner image is first transferred to an intermediate transfer belt, and this toner image is then transferred to the electrophotographic image-receiving sheet in another step. From the viewpoint of environmental stability and high image quality, the intermediate transfer belt transfer method is more preferable.

One example of a fixing-belt device, which is used for the process for image formation of the present invention, is shown in FIGURE. In the fixing-belt devise 10, the fixing belt 2 is suspended across a heating roller 3 and tension roller 5. A cleaning roller 6 is provided above the tension roller 5, putting the fixing belt 2 between, and a pressure roller 4 is provided below the heating roller 3, putting the fixing belt 2 between. The electrophotographic image-receiving sheet comprising the toner image is inserted between the heating roller 3 and pressure roller 4 from the right-hand side in FIGURE, fixed, and then carried on the fixing belt 2 to be cleaned by the cleaning roller 6.

Regarding transfer, from the viewpoint of improving image quality, a viscoadhesive transfer or thermal support transfer method may be used instead of or in conjunction with electrostatic transfer or bias roller transfer. Specific examples of this construction are given in JP-A No.63-113576 and JP-A No.05-341666. In particular, the intermediate transfer belt of the thermal support transfer method is preferable when using an electrophotographic color toner having a small particle diameter (7 $\mu$m or less). The intermediate transfer belt may for example be an endless belt formed of electrocast nickel, having a thin film of a silicone or fluorine compound on the surface, and to which peeling properties have been imparted. A cooling device may also be provided in the intermediate transfer belt after transfer of toner to the image-receiving sheet, or in the latter half of the transfer process.

Due to this cooling device, the electrophotographic toner can be cooled to or below the softening temperature or the glass transition temperature of the binder which is used therein, efficiently transferred to the electrophotographic image-receiving sheet, and peeled away from the intermediate transfer belt.

Fixing is an important step which affects the gloss and smoothness of the final image. Fixing methods known in the art are fixing by a heating and pressurizing roller and belt fixing using a belt. From the viewpoint of image quality such as gloss and smoothness, the belt fixing method is preferred.

The belt fixing method may for example be the oil-less type of belt fixing method described in JP-A No. 11-352819 or the method where secondary transfer and fixing are simultaneously performed as described in JP-A No. 11-231671 and JP-A No. 05-341666.

To prevent peeling of toner or offset of the toner component, the surface of the fixing belt used in the belt fixing method is preferably coated by a surface treatment with a surface treatment agent of the silicone type, fluorine type or combined type. Also, a cooling apparatus for the fixing belt is preferably provided in the latter half of the fixing step to improve peeling of the electrophotographic image-receiving sheet.

The cooling temperature of the cooling device preferably cools to or less than the softening point or the glass transition point of the binder resin in the electrophotographic color toner, and the thermoplastic resin used in the toner image-receiving layer of the electrophotographic image-receiving sheet. On the other hand, in the initial stage of the fixing step, the temperature of the toner image-receiving layer or electrophotographic color toner in the electrophotographic image-receiving sheet must be raised sufficiently to the softening temperature. Specifically, the cooling temperature is preferably 30° C. to 70° C. in practice, and the temperature in the initial stage of the fixing step is more preferably 100° C. to 180° C.

The present invention will now be described in more detail referring to specific examples, but it will be understood that the invention is not to be construed as being limited thereby.

EXAMPLE 1

Preparation of Undercoat Layer Coating Solution 60 parts by mass of water were added to 40 parts by mass of enzyme decomposed gelatin (weight average molecular weight: 10,000, PAGI method viscosity: 15 mP, PAGI method jelly strength: 20 g), and stirred and dissolved at 40° C. Next, 40 parts by mass of pearl gloss pigment (Iriodin #123 (titanium oxide cladded mica), manufactured by MERCK & CO., INC., granularity: 5 $\mu$m to 25 $\mu$m, volume average particle diameter ($D_{50}$): 18 $\mu$m, aspect ratio: 45, geometrical thickness of cladding layer: 60 nm, titanium oxide cladding ratio: 39%) and 60 parts by mass of water were stirred together, and mixed with the gelatin solution so as to prepare an undercoat layer coating solution. 7 parts by mass of an epoxy type gelatin-film curing agent having the following structure were also added before application.

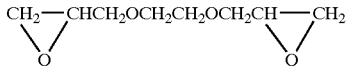

Preparation of Support

A wood pulp comprising 100 parts by mass of LBKP100 was beaten to a Canadian Freeness of 300 cc using a double disk refiner, and 0.5 parts by mass of epoxy behenic acid, 1.0 parts by mass of anionic polyacrylamide, 0.1 parts by mass of polyamide polyamine epichlorhydrin and 0.5 parts by mass of cationic polyacrylamide were added in terms of absolute dry mass ratio to manufacture a raw paper of weighting 150 g/m$^2$ using a fortlinear paper machine, then this was surface sized with 1.0 g/m$^2$ of polyvinyl alcohol in terms of absolute dry mass, and adjusted to a density of 1.0 g/m$^3$ by a calender treatment.

The wire surface (undersurface) of the raw paper was subjected to a corona discharge treatment, and coated with high-density polyethylene having a thickness of 35 $\mu$m by an extruding machine to form an undercoat layer resin layer having a matt surface.

Then, the felt surface (top surface) of the raw paper was subjected to a corona discharge treatment, and coated with 10 parts by mass of anatase titanium oxide together with high-density polyethylene/low-density polyethylene (70/30) containing a small amount of ultramarine, having a thickness of 30 $\mu$m by an extruding machine, to form a surface resin layer (polyolefin coated layer) having a glossy surface so as to manufacture a support.

Formation of Undercoat Layer

The surface of the surface resin layer was subjected to corona discharge treatment, and then the aforesaid undercoat layer coating solution was applied (coating amount after drying: 2.0 g/m$^2$) so as to form an undercoat layer and manufacture a support.

Manufacture of Electrophotographic Image-receiving Sheet

A toner image-receiving layer coating solution having the following composition was coated on the undercoat layer of the support to a film thickness of 10 $\mu$m in terms of solids, and a toner image-receiving layer was thereby formed so as to obtain an electrophotographic image-receiving sheet.

Composition of Toner Image-receiving Layer Coating Solution

| | |
|---|---|
| Water-dispersible polyester resin (Eritel KZA-1449, Unitika Ltd. (solids concentration 30% by mass)) | 100 parts by mass |
| Water-dispersible carnauba wax (Chukyo Oils and Fats), Cellosol 524F, (solids 30% by mass) | 5 parts by mass |
| Surfactant (Nippon Oils and Fats, Rapizol B-90) | 1 part by mass |
| Ion-exchange water | 100 parts by mass |

<Evaluation>

The regular reflectance of the surface of the obtained electrophotographic image-receiving sheet where a toner image is formed, is shown in Table 1.

In the present invention, "regular reflectance" is a value calculated by the following equation (1):

$$\text{regular reflectance} = \text{spectral total reflectance} - \text{diffuse reflectance} \quad \text{equation (1)}$$

<<Evaluation of Image Formation, Brilliance and Sense of Depth>>

An image was formed on the obtained electrophotographic image-receiving sheet using a color laser printer C-2200 (Fuji Xerox, Co., Ltd.), the surface of the image was visually observed, and brilliance and sense of depth were evaluated according to the following evaluation criteria. The results are shown in Table 1.

When the image was formed, as shown in FIGURE, the fixing belt device 10 was adapted and the original fixing belt 2 schematically was disposed in the printer image-receiving sheet. discharge unit so that discharge and paper feed could be synchronized.

Evaluation Criteria

◎: Brilliance is very high, and sense of depth is felt strongly
○: Brilliance is high, and sense of depth is felt strongly
Δ: Not much of brilliance and sense of depth
×: No brilliance and sense of depth <<Evaluation of Distinction and Sharpness>>

The image surface was visually observed, and distinction and sharpness where evaluated according to the following evaluation criteria. The results are shown in Table 1.

Evaluation Criteria

◎: Distinctiveness is very high, and sharpness is very high
○: Distinctiveness and sharpness are both high
Δ: Not much of distinctions or sharpness
×: No distinctions or sharpness

COMPARATIVE EXAMPLE 1

An electrophotographic image-receiving sheet was manufactured in an identical way to that of Example 1, except that the undercoat layer was not formed, and an evaluation was performed in an identical way to that of Example 1. The results are shown in Table 1.

COMPARATIVE EXAMPLE 2

An electrophotographic image-receiving sheet was manufactured in an identical way to that of Example 1, except that the pearl gloss pigment was not used in the manufacture of the "undercoat layer coating solution" of the Example 1, and an evaluation was performed in an identical way to that of Example 1. The results are shown in Table 1.

TABLE 1

| | Example 1 | Comp. Ex. 1 | Comp. Ex. 2 |
|---|---|---|---|
| regular reflectance of image-receiving layer (440 nm) | 5.40% | 1.10% | 1.14% |
| regular reflectance of image-receiving layer (560 nm) | 5.23% | 1.04% | 1.12% |
| Image quality (brilliance and sense of depth | ◎ | Δ | Δ |
| Image quality (distinctiveness and sharpness) | ◎ | Δ | Δ |

According to the present invention, an electrophotographic image-receiving sheet which forms an image having excellent brilliance, sense of depth and superior distinction, and high sharpness, can be provided.

What is claimed is:

1. An electrophotographic image-receiving sheet comprising:

a support; and a toner image-receiving layer on at least one surface of the support, wherein at least one of the toner image-receiving layer and the support contains a metal oxide-cladded mica having a volume average particle diameter ($D_{50}$) of 2.0 $\mu$m or more, and wherein a regular reflectance of a surface of the toner image-receiving layer at 440 nm and a regular reflectance of the surface of the toner image-receiving layer at 560 nm are both 2% or more.

2. An electrophotographic image-receiving sheet according to claim 1, wherein a regular reflectance of a surface of the support at 440 nm and a regular reflectance of the surface of the support at 560 nm are both 2% or more.

3. An electrophotographic image-receiving sheet according to claim 1, wherein a ratio of the regular reflectance of the surface of the toner image-receiving layer at 440 nm and a diffuse reflectance of the surface of the toner image-receiving layer at 440 nm (regular reflectance/diffuse reflectance) is 3/100 or more.

4. An electrophotographic image-receiving sheet according to claim 1, wherein the volume average particle diameter ($D_{50}$) of the metal oxide-cladded mica is 3.0 $\mu$m or more.

5. An electrophotographic image-receiving sheet according to claim 1, wherein an aspect ratio of the metal oxide-cladded mica is 10 or more.

6. An electrophotographic image-receiving sheet according to claim 1, wherein a geometric thickness of a cladding layer in the metal oxide-cladded mica is 30 nm or more.

7. An electrophotographic image-receiving sheet according to claim 1, wherein the metal oxide-cladded mica is a titanium oxide-cladded mica.

8. An electrophotographic image-receiving sheet comprising:

a support; and a toner image-receiving layer on at least one surface of the support;

further comprising at least one of:

an undercoat layer between the support and the toner image-receiving layer; and a surface protective layer on the toner image-receiving layer, wherein at least one of the toner image-receiving layer, the support, the undercoat layer and the surface protective layer contains a metal oxide-cladded mica having a volume average particle diameter ($D_{50}$) of 2.0 $\mu$m or more.

9. An electrophotographic image-receiving sheet according to claim 8, wherein the undercoat layer contains the metal oxide-cladded mica.

10. An electrophotographic image-receiving sheet according to claim 8, wherein the volume average particle diameter ($D_{50}$) of the metal oxide-cladded mica is 3.0 $\mu$m or more.

11. An electrophotographic image-receiving sheet according to claim 8, wherein an aspect ratio of the metal oxide-cladded mica is 10 or more.

12. An electrophotographic image-receiving sheet according to claim 8, wherein a geometric thickness of a cladding layer in the metal oxide-cladded mica is 30 nm or more.

13. An electrophotographic image-receiving sheet according to claim 8, wherein the metal oxide-cladded mica is a titanium oxide-cladded mica.

14. An electrophotographic image-receiving sheet according to claim 1, wherein the support is one of raw paper, synthetic paper, synthetic resin sheet, coated paper and laminated paper.

15. A process for image formation comprising the steps of:

forming a toner image on a surface of electrophotographic image-receiving sheet;

heating and pressurizing the toner image on the surface of electrophotographic image-receiving sheet with a fixing belt and a fixing roller; and cooling the toner image on the surface of the electrophotographic image-receiving sheet so as to separate the electrophotographic image-receiving sheet from the fixing belt, wherein the electrophotographic image-receiving sheet comprises:

a support; and a toner image-receiving layer on at least one surface of the support, wherein at least one of the toner image-receiving layer and the support contains a metal oxide-cladded mica having a volume average particle diameter ($D_{50}$) of 2.0 $\mu$m or more, and wherein a regular reflectance of a surface of the toner image-receiving layer at 440 nm and a regular reflectance of the surface of the toner image-receiving layer at 560 nm are both 2% or more.

16. A process for image formation according to claim 15, wherein cooling is performed below one of a softening point and a glass transition temperature of a thermoplastic resin in the toner image-receiving layer.

17. An electrophotographic image-receiving sheet according to claim 1, wherein the support is a polyolefin-coated layer which comprises the metal oxide-cladded mica, and wherein the content of the metal oxide-cladded mica therein is 0.5% by mass or more.

18. An electrophotographic image-receiving sheet according to claim 1, wherein the toner image-receiving layer comprises the metal oxide-cladded mica, and wherein the content of the metal oxide-cladded mica therein is 0.1% by mass or more.

19. An electrophotographic image-receiving sheet according to claim 8, wherein the undercoat layer comprises the metal oxide-cladded mica, and wherein the content of the metal oxide-cladded mica therein is 0.1% by mass or more.

20. An electrophotographic image-receiving sheet according to claim 8, wherein the surface protective layer comprises the metal oxide-cladded mica, and wherein the content of the metal oxide-cladded mica therein is 0.1% by mass or more.

* * * * *